US006286470B1

(12) United States Patent
Riksen et al.

(10) Patent No.: US 6,286,470 B1
(45) Date of Patent: Sep. 11, 2001

(54) STARTING PROCESS FOR AN INTERNAL-COMBUSTION ENGINE

(75) Inventors: Bertil Riksen; Jens Kriese; Franz Rosskopf, all of Munich; Steffen Lutz, Karlsfeld; Winfried Weuste, Deisenhofen; Oliver Froelich, Munich, all of (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 09/394,879

(22) Filed: Sep. 13, 1999

(30) Foreign Application Priority Data

Sep. 11, 1998 (DE) ..... 198 41 752

(51) Int. Cl.[7] ..... F02M 11/08
(52) U.S. Cl. ..... 123/179.3
(58) Field of Search ..... 123/179.3, 179.4; 290/38 R, 38 C, 38 A

(56) References Cited

U.S. PATENT DOCUMENTS 4,577,599 * 3/1986 Chmielewski ..... 123/179.3
4,901,689 * 2/1990 Cummins et al. ..... 123/179.3
5,337,713 * 8/1994 Mills ..... 123/179.3
5,601,058 * 2/1997 Dyches et al. ..... 123/179.2
5,713,320 * 2/1998 Pfaff et al. ..... 123/179.3
6,040,634 * 3/2000 Larguier ..... 290/45

FOREIGN PATENT DOCUMENTS 44 05 688 8/1994 (DE) .
195 32 135 3/1997 (DE) .
196 32 074 2/1998 (DE) .
297 23 175 6/1998 (DE) .
0 569 347 11/1993 (EP) .

* cited by examiner

*Primary Examiner*—Andrew M. Dolinar
*Assistant Examiner*—Arnold Castro
(74) *Attorney, Agent, or Firm*—Crowell & Moring LLP

(57) ABSTRACT

A process and apparatus for starting an internal-combustion engine of a vehicle is provided, having a starting device for starting the internal-combustion engine in which the rotational starting speed can be controlled or automatically controlled. For minimizing starting energy, shortening the starting time, increasing the starting safety and reducing the emissions during the start, the rotational speed generated by the starting device is adjusted to a defined maximal rotational starting speed.

11 Claims, 2 Drawing Sheets

STARTING PROCESS FOR AN INTERNAL-COMBUSTION ENGINE

BACKGROUND AND SUMMARY OF THE INVENTION

This application claims the priority of German Application No. 198 41 752.7, filed Sep. 11, 1998, the disclosure of which is expressly incorporated by reference herein.

The invention relates to a process for starting an internal-combustion engine.

Conventional starting systems or starters are designed for commercially conventional cold-start limit temperatures. Under defined marginal parameters, such as the oil viscosity, the battery condition, the voltage drop, the compression quality, etc., a certain rotational starting speed occurs at a defined cold-start limit temperature. At other starting temperatures and other or undefined marginal parameters, the rotational starting speed is essentially accidental. This results in random starting events, for example, in the case of the required energy, the starting times, the starting safety and the exhaust gas crude emissions.

Possible measures using electronic control systems are conventionally used for increasing the operational safety and for reducing the starter noise.

It is an object of the present invention to provide a method for starting an internal-combustion engine with a view to an improved starting strategy. In the case of the present invention, the required electric starting energy is reduced, the starting time is shortened, the starting safety is increased and the crude emissions can be reduced.

This and other objects are achieved by a process for starting an internal-combustion engine, having a starting device in the case of which the rotational starting speed can be controlled or automatically controlled, characterized in that the rotational speed generated by the starting device can be adjusted to a defined maximal rotational starting speed.

Accordingly, in the case of a starting device for starting an internal-combustion engine, in which the rotational starting speed is controllable or automatically controllable, a defined maximal rotational starting speed is set. The maximum rotational starting speed (hereinafter abbreviated as: maximum rotational speed) is preferably selected as a function of vehicle operating and/or internal-combustion engine parameters. As a result of the defined rotational starting speed, a synchronization of the control units, of the transmission line and of the first firing of the internal-combustion engine can take place. This saves electric starting energy. Furthermore, the parameters for the ignition and the mixture preparation can be adjusted in a targeted manner to the defined rotational speed. This results in a much more precise adjustment than in the case of conventional starting devices, wherein the adjustment cannot be coordinated with the rotational starting speed in the required manner. By means of the measure according to the present invention, crude emissions during the starting phase can therefore clearly be reduced.

In order to achieve a good balancing of energy, the acceleration up to the defined rotational starting speed takes place with a torque which is optimal for the starting motor and the internal-combustion engine. This again saves electric starting energy. Furthermore, the starting device can promote the running-up of the engine during a start to a provided rotational starting end speed, so that a secure starting—also in the case of a cold start—will always be ensured.

In a particularly advantageous embodiment of the present invention, the crankshaft is adjusted to an angular value which is positive for the start. By means of this adjustment (for example, the approaching of a synchronization mark), the synchronization time during the subsequent start can be reduced approximately by up to one revolution. This also contributes to the improvement of the energy balance of the starting battery. The rotation of the crankshaft into this positive starting position can take place before an imminent start, but in a still more advantageous manner, during or after the switching-off of the internal-combustion engine. In the latter case, the energy expenditure for the rotation or the stopping of the crankshaft is the lowest because the engine is still warm.

Other objects, advantages and novel features of the present invention will become apparent from the following detailed description of the invention when considered in conjunction with the accompanying drawings.

DETAILED DESCRIPTION OF THE DRAWINGS

Figure 1:
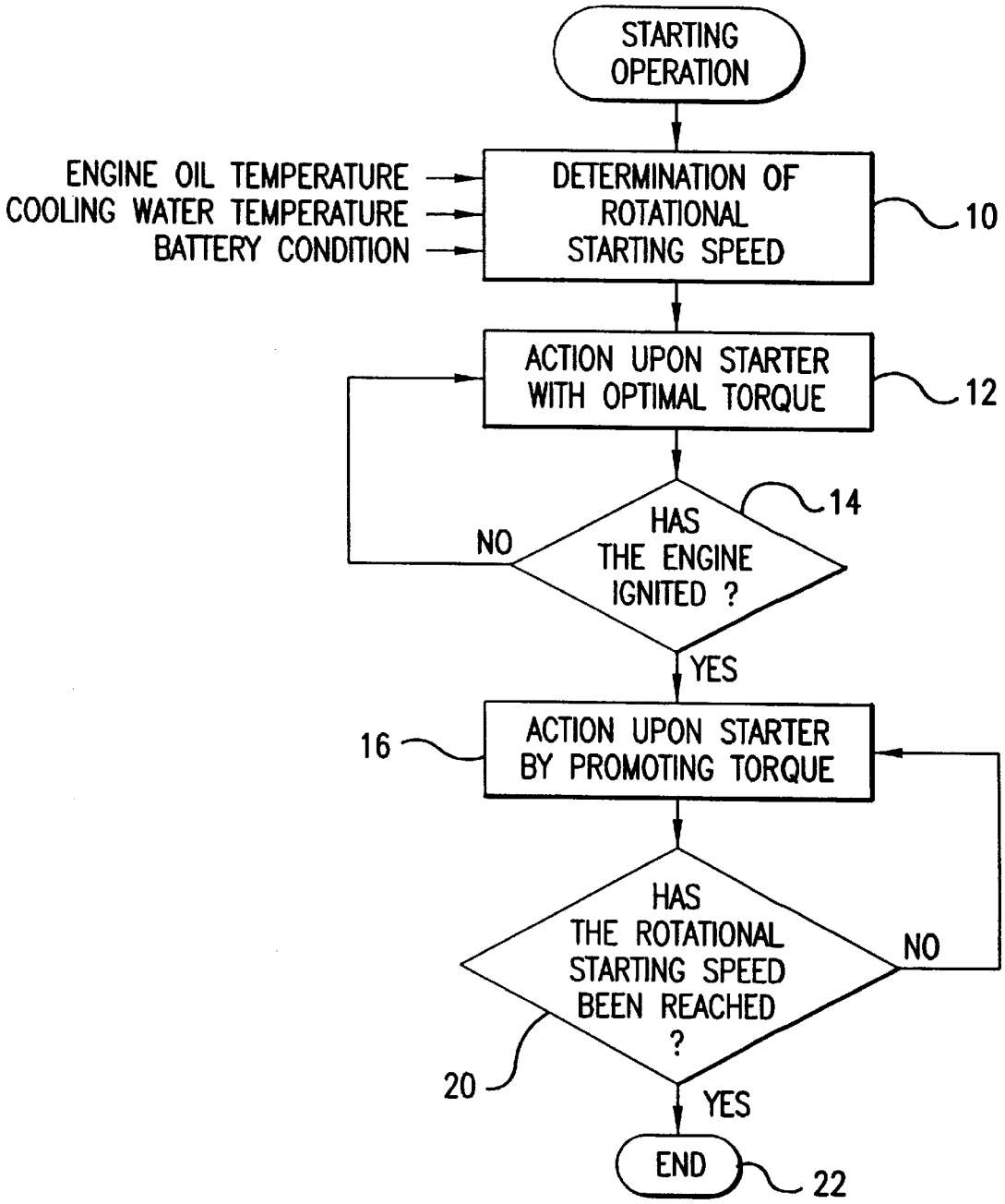
FIG. 1 is a flow chart of a process according to the invention for starting an internal-combustion engine.

One of the decisive points of the present invention is the adjusting of the starter to a defined rotational starting speed. The sequence of such a process is illustrated in FIG. 1. First, based on different engine operating or internal-combustion engine parameters, a rotational starting speed is determined during the starting operation (step 10). For this purpose, the engine oil temperature, the cooling water temperature and the battery condition are queried. However, as an alternative, it is also possible to use other vehicle operating or internal-combustion engine parameters for determining the maximal rotational speed for the starting operation.

Subsequently, in step 12, the starter is acted upon by the optimal engine torque. In step 14, it is checked whether the engine has ignited.

If this is not so (no), a return takes place to step 12 and the starter is continuously acted upon with the optimal engine torque.

If the condition in step 14 has been met (yes), in step 16, the engine is acted upon despite the ignition by a torque which further promotes the starting operation. For example, in the winter, this measure ensures a secure starting of the engine.

In step 20, it is checked whether the rotational starting speed has been reached. If this is not so (no), a return takes place to step 16. However, if the checking in step 20 is positive (yes), the process is terminated in step 22.

Figure 2:
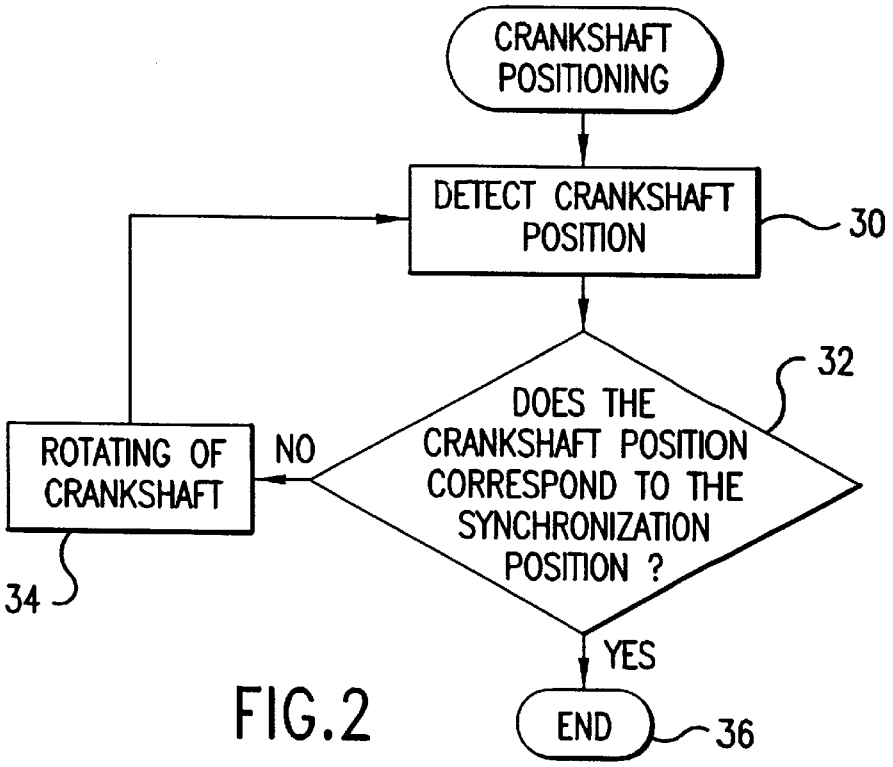
FIG. 2 is a schematic flow chart for adjusting the crankshaft to an angular value advantageous for a subsequent start.

It is additionally advantageous for the crankshaft to be brought into a synchronization position which is optimal for the subsequent start before the starting operation. For this purpose, according to FIG. 2, in step 30, the crankshaft position is detected. In step 32, the detected crankshaft position is compared to see whether this crankshaft position corresponds to a synchronization position.

If this is not so (no), the crankshaft is rotated in step 34. This operation is repeated until the crankshaft is situated in a defined position. This position is used for improving the energy balance during the start. The process can be implemented in that the crankshaft is moved by the starting device in a targeted manner, for example, to a gap in a crankshaft input wheel and is stopped at a synchronization mark.

Figure 3:
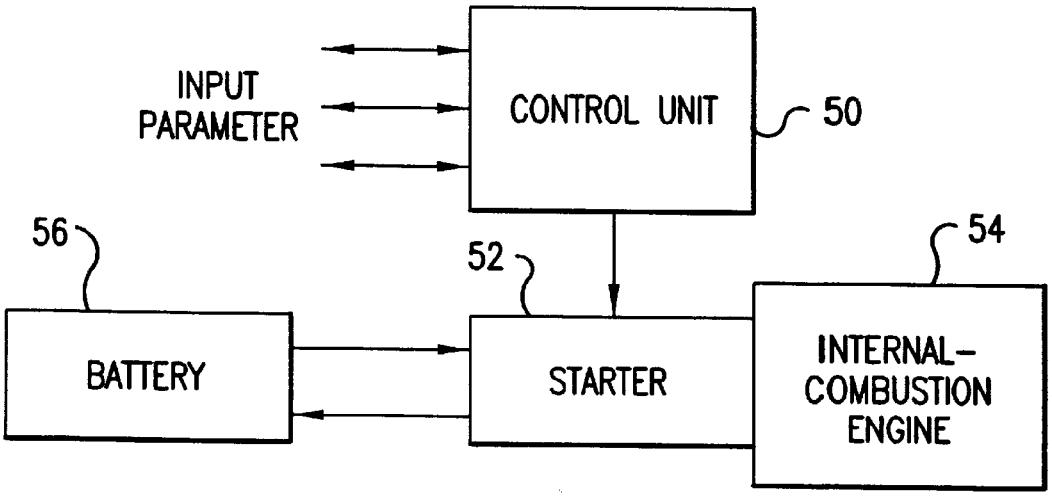
FIG. 3 is a simple schematic block diagram of an apparatus in which the present process can be implemented.

FIG. 3 shows a schematic block diagram of an arrangement for carrying out the process according to the invention. A control unit 50 receives the different vehicle operating and internal-combustion engine input parameters. In addition, the ignition lock also emits a starter signal to the control system 50. On the basis of the input parameters, the control system 50 computes the maximal rotational speed to be defined and causes the starter 52 to rotate at this defined rotational speed. The starter 52 receives its energy from a battery 56 and is constructed, for example, in the form of a crankshaft starter generator. These starter/generator arrangements are capable of automatically controlling the rotational speed. As an alternative, any other starting system can also be used if it has sufficient starting power and its operation can be influenced. The starter drives the internal-combustion engine 54 so that this internal-combustion engine 54 can be successfully ignited.

The above described process and arrangement can be operated under software control, for example via a suitably programmed control unit 50. Of course, the process could also be implemented with a hard-wired circuit or some combination of both hardware and software.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A process for starting an internal-combustion engine, having a starter, the process comprising the acts of:

generating a rotational starting speed via the starter in a controlled manner, said starter being coupled to said engine prior to operation of said starter;

selecting a defined maximal rotational starting speed as a function of at least vehicle operating and internal-combustion engine parameters; and adjusting the rotational starting speed generated by the starter to said defined maximal rotational starting speed.

2. The process according to claim 1, further comprising the act of essentially operating the starter via battery energy with an optimal torque until the defined maximal rotational starting speed is achieved.

3. The process according to claim 1, further comprising the act of increasing the speed of the starting motor after a successful ignition of the internal-combustion engine until said starting rotational speed is reached.

4. The process according to claim 2, further comprising the act of increasing the speed of the starting motor after a successful ignition of the internal-combustion engine unit said starting rotational speed is reached.

5. The process according to claim 1, further comprising the acts of:

detecting an angular position of a crankshaft; and bringing the crankshaft into a position which is positive for a starting operation such that a synchronization time period during the starting operation improves.

6. The process according to claim 2, further comprising the acts of:

detecting an angular position of a crankshaft; and bringing the crankshaft into a position which is positive for a starting operation such that a synchronization time period during the starting operation improves.

7. The process according to claim 3, further comprising the acts of:

detecting an angular position of a crankshaft; and bringing the crankshaft into a position which is positive for a starting operation such that a synchronization time period during the starting operation improves.

8. The process according to claim 5, further comprising the act of moving the crankshaft to a synchronization mark by the starter.

9. The process according to claim 5, further comprising the act of bringing the crankshaft into a positive position during a switching-off of the internal-combustion engine.

10. The process according to claim 8, further comprising the act of bringing the crankshaft into a positive position during a switching-off of the internal-combustion engine.

11. An apparatus for starting an internal-combustion engine, comprising:

a starter operatively coupled, with the internal-combustion engine; prior to operation of said starter;

a battery coupled with said starter to provide electrical starting energy; and a control unit coupled with said starter, said control unit receiving input parameters and providing a maximal rotational speed signal to said starter as a function of said input parameters.

* * * * *